US012653290B2

(12) United States Patent
Akerele et al.

(10) Patent No.: US 12,653,290 B2
(45) Date of Patent: Jun. 16, 2026

(54) GREY-HAIR DETECTION AND TREATMENT SYSTEM

(71) Applicant: L'Oreal, Paris (FR)

(72) Inventors: Dominic Akerele, Brooklyn, NY (US); Richard Besen, New York, NY (US); Guive Balooch, Paris (FR); Fred Orsita, New York, NY (US)

(73) Assignee: L'Oréal, Paris (FR)

( * ) Notice: Subject to any disclaimer, the term of this patent is extended or adjusted under 35 U.S.C. 154(b) by 494 days.

(21) Appl. No.: 18/160,212

(22) Filed: Jan. 26, 2023

(65) Prior Publication Data

US 2023/0240422 A1 Aug. 3, 2023

Related U.S. Application Data

(60) Provisional application No. 63/304,457, filed on Jan. 28, 2022.

(30) Foreign Application Priority Data

Mar. 3, 2022 (FR) ..... 2201845

(51) Int. Cl.
*A45D 19/02* (2006.01)
*A45D 19/00* (2006.01)
*A45D 24/28* (2006.01)

(52) U.S. Cl.
CPC ..... *A45D 19/026* (2021.01); *A45D 19/0066* (2021.01); *A45D 19/022* (2021.01); *A45D 24/28* (2013.01)

(58) Field of Classification Search
CPC ..... A45D 19/026; A45D 19/0066; A45D 19/022; A45D 24/28; A45D 24/22;
(Continued)

(56) References Cited

U.S. PATENT DOCUMENTS

2003/0065450 A1* 4/2003 Leprince ..... A45D 44/005 702/19
2004/0159329 A1* 8/2004 Kennedy ..... A45D 19/026 132/208

(Continued)

FOREIGN PATENT DOCUMENTS

CN 208228567 U 12/2018
FR 2933585 A1 1/2010

(Continued)

OTHER PUBLICATIONS

English machine translation of FR2933585 (Year: 2010).*

(Continued)

*Primary Examiner* — Iriana Cruz
(74) *Attorney, Agent, or Firm* — CHRISTENSEN O'CONNOR JOHNSON KINDNESS PLLC

(57) ABSTRACT

A system for coloring hair, the system including at least one cartridge containing a hair color, a hair color device comprising one or more chambers configured to receive the at least one cartridge, and a processor communicatively coupled to the dispense, wherein the process or is configured to visualize an image of a user's hair, detect one or more hairs in a predetermined color range in the image through image processing, and apply the hair color onto the one or more hairs in a predetermined color range through an applicator on the hair color device.

17 Claims, 5 Drawing Sheets

(58) Field of Classification Search
CPC ..... A45D 44/005; A45D 2044/007; A45D 19/012; A45D 2024/002; A61B 5/0077; A61B 5/1032; A61B 5/6887; A61B 5/448; G06T 7/0012
See application file for complete search history.

(56) References Cited

U.S. PATENT DOCUMENTS

| | | | | |
|---|---|---|---|---|
| 2010/0224205 | A1* | 9/2010 | Mitra | A61B 5/448 132/202 |
| 2011/0313885 | A1* | 12/2011 | Mourad | G06Q 30/0621 705/26.5 |
| 2016/0166032 | A1* | 6/2016 | Grez | A45D 19/026 132/221 |
| 2016/0183664 | A1* | 6/2016 | Grez | A45D 44/005 132/200 |
| 2017/0258194 | A1* | 9/2017 | Medearis | A46B 5/0095 |
| 2020/0193503 | A1* | 6/2020 | Mathiaszyk | G06Q 30/0623 |
| 2023/0189957 | A1* | 6/2023 | Attal | A45D 19/18 132/208 |

FOREIGN PATENT DOCUMENTS

| | | | |
|---|---|---|---|
| JP | 2012055370 | A | 3/2012 |
| JP | 2012511406 | A | 5/2012 |
| JP | 2018506331 | A | 3/2018 |
| KR | 20200058455 | A | 5/2020 |

OTHER PUBLICATIONS

International Preliminary Report on Patentability (IPRP) mailed Aug. 8, 2024, issued in corresponding International Application No. PCT /US2023/061396, filed Jan. 26, 2023, 12 pages.
International Search Report and Written Opinion mailed Mar. 20, 2023, issued in corresponding International Application No. PCT/US2023/061396, filed Jan. 26, 2018, 18 pages.
French Preliminary Search Report and Written Opinion mailed Sep. 27, 2022, issued in corresponding French Application No. 2201845, filed Mar. 3, 2022, 10 pages.
Office Action received Jul. 9, 2025, issued in Japanese Application No. 2024-544712, filed Jan. 26, 2023, 8 pages.
Office Action received Aug. 27, 2025, issued in Korean Application No. 10-2024-7025892, filed Jan. 26, 2023, 9 pages.

* cited by examiner

GREY-HAIR DETECTION AND TREATMENT SYSTEM

CROSS-REFERENCES TO RELATED APPLICATIONS

The present application claims priority to and the benefit of U.S. Provisional Application No. 63/304,457, filed Jan. 28, 2022, and French Application No. 2201845, filed Mar. 3, 2022, the entire disclosures of which are hereby incorporated by reference herein in their entirety for all purposes.

SUMMARY

This summary is provided to introduce a selection of concepts in a simplified form that are further described herein in the Detailed Description. This summary is not intended to identify key features of the claimed subject matter, nor is it intended to be used as an aid in determining the scope of the claimed subject matter.

As people age, their hair often begins to turn gray or white. In some cases, it can be difficult to determine where grey hairs are, especially if an individual has a lighter hair color. Additionally, when people dye their hair, their natural hair color eventually begins to appear at the roots of their hair. Accordingly, systems for diagnosing grey or natural hair color and applying dye to a specific, localized area are needed. Herein is a description of example devices and methods that are capable of detecting grey hairs and applying a localized hair dye to the grey hairs.

In one aspect, a system for coloring hair, the system comprising at least one cartridge containing a hair color, a hair color device configured to receive the at least one cartridge; and a processor communicatively coupled to the hair color device, wherein the processor is configured to visualize an image of a user's hair, set a probability threshold for an undesired hair color, assign a probability to each pixel of the image as being: a desired hair, an undesired hair, or scalp, wherein the desired hair is a desired color and wherein the undesired hair is an undesired color, and apply the hair color onto the one or more pixels that exceed the probability threshold of the undesired hair color through an applicator on the hair color device.

In another aspect, a method of coloring hair using the system of any of the preceding claims, the method comprising visualizing an image of a user's hair, setting a probability threshold for an undesired hair color, assigning a probability to each pixel of the image as being a desired hair, an undesired hair, or scalp, wherein the desired hair is a desired hair color, and wherein the undesired hair is the undesired hair color, and applying the hair color onto the one or more pixels that exceed the probability threshold of the undesired hair color through an applicator on the hair color device is disclosed.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

While illustrative embodiments have been illustrated and described, it will be appreciated that various changes can be made therein without departing from the spirit and scope of the invention.

Described herein are systems and methods for detecting hair that is an undesired color and applying hair dye to that localized hair or area. In some embodiments, the undesired color is grey or white hair. In some embodiments, the undesired color is a user's natural hair color. In some embodiments, a user can move the hair color device over their hair to detect the undesired hair. In some embodiments, the hair color device includes an IR camera and optical sensor to take an image of the user's hair as they move the device over the hair. In some embodiments, the hair color device can detect undesired hairs, desired hairs, and the user's scalp using image processing. In some embodiments, the hair color device then applies hair color to the undesired hairs based on the processed images of the user's hair. In an embodiment, the user actuates a user input to direct the hair color device to apply the hair color.

In an embodiment, the hair color device is communicatively coupled to a communication device, such as a smartphone. In some embodiments, the user can direct the hair color device to begin taking images or apply hair color through an interface on the communication device. In some embodiments, the hair color device or the communication device can alert the user that the hair color will be applied.

In some embodiments, the hair color device is configured to accept one or more cartridges containing a hair color. In some embodiments, the hair color is a semi-permanent, demi-permanent, permanent, or wash-out hair dye. In some embodiments, the cartridge further contains a hair color treatment, such as an oxidant or a toner. In some embodiments, a second cartridge contains the hair color treatment. In some embodiments, the hair color device applies the hair color treatment before applying the hair dye. In some embodiments, the user swaps out the cartridges to apply the hair color treatment before applying the hair dye.

Figure 1A:
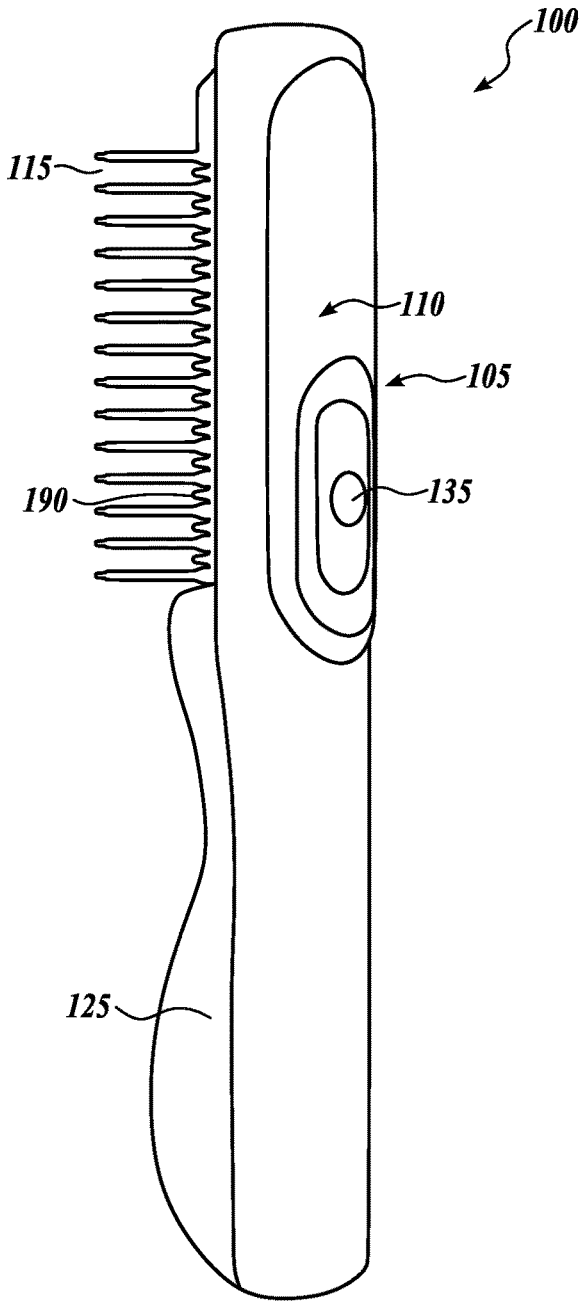
FIGS. 1A-1B are example hair color devices, in accordance with the present technology.
Figure 1B:
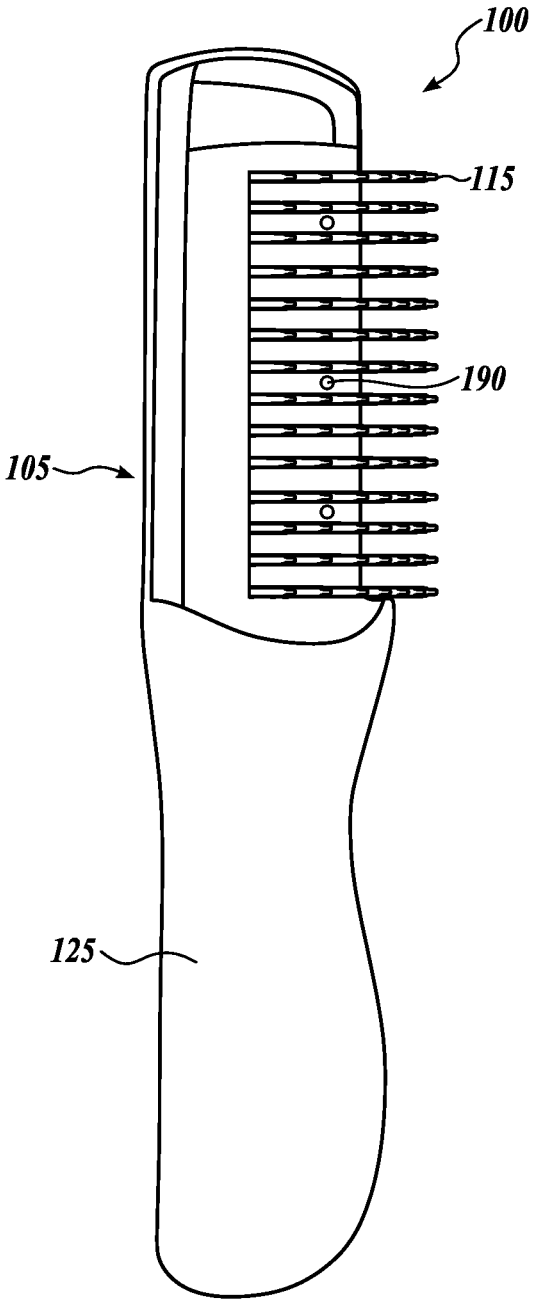

FIGS. 1A-1B are example hair color devices 100, in accordance with the present technology. In some embodiments, the hair color device 100 has a form factor similar to that of a hairbrush or a comb. The hair color device 100 may include a body 105, a cartridge 110, and an applicator 190. In some embodiments, the hair color device 100 also has a handle 125. In some embodiments, the handle 125 and the body 110 are removably attached, but in other embodiments, the handle 125 and the body 110 are a single piece. In some embodiments, the hair color device 100 includes a user input 135.

Figure 2:
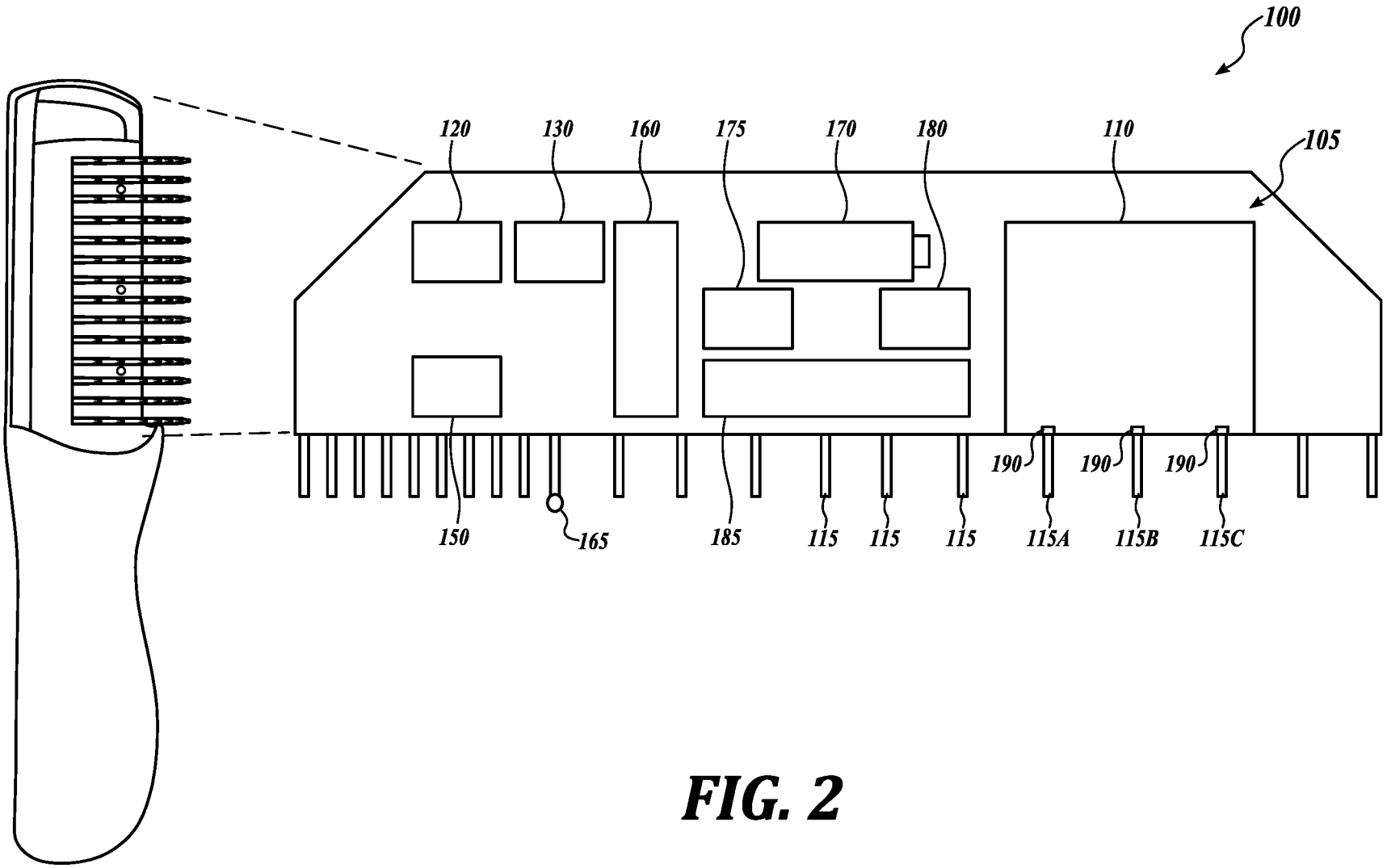
FIG. 2 is an internal view of an example hair color device, in accordance with the present technology.

As illustrated in FIG. 1A, the hair color device 100 may include a cartridge 110. In some embodiments, the hair color device 100 may have more than one cartridge 100. In some embodiments, the cartridge 110 may be attached to the body 105 of the hair color device 100, as illustrated in FIG. 1A, but in some embodiments, the cartridge may be disposed inside the body 105 of the hair color device 100 as illustrated in FIG. 2. In yet other embodiments, the cartridge 110 may be located on another portion of the hair color device 100, such as inside or on the handle 125.

In some embodiments, the cartridge 110 contains a hair color. In some embodiments, the hair color is a semi-permanent hair dye, but in other embodiments, the hair color may be a wash-out hair dye. In some embodiments, the hair color is a permanent or demi-permanent hair color. In some embodiments, the system further includes a second cartridge 110 containing a hair color treatment. In some embodiments, the hair color treatment is a toner. In some embodiments, the hair color treatment is an oxidant. In some embodiments, the hair color device 110 may accept more than one cartridge 110: one for the hair color, and one for the hair color treatment. In some embodiments, both the hair dye and the hair color treatment may be inside the same cartridge 110 but separated into chambers to prevent mixing. In some embodiments, each chamber may line up with a separate applicator 190 so they can be dispensed separately. In some embodiments, the hair treatment is applied before applying the hair color.

In some embodiments, the cartridge 110 has an identifier, such as a QR code or an RFID tag so that the hair color device 100 can identify the color of the hair dye, type of hair dye, or the type of hair color treatment. In some embodiments, the color of the hair dye in the cartridge 110 can inform the desired hair color as described in FIG. 2.

While the user input 135 is illustrated as a button on FIG. 1A, the user input 135 can take any number of forms including a switch or a touch-type capacitive button. In operation, the user can actuate the user input to begin the imaging process described in detail herein. In some embodiments, the user can further actuate the user input to direct the device to apply the hair treatment and/or the hair color.

In some embodiments, the hair color device 100 includes a plurality of bristles 115. In some embodiments, the bristles are configured to be brushed through the user's hair. In operation, the plurality of bristles 115 can be brushed through a user's hair to untangle and smooth a user's hair, to separate the user's hair into manageable sections for imaging, and to provide therapeutic massage to a user's scalp.

In some embodiments, such as those illustrated by FIGS. 1A-1B, the applicator 190 is disposed among the bristles. In some embodiments, the applicator is a mechanical pump. In some embodiments, the applicator is a solenoid pump. In some embodiments, the applicator is a microfluidic pump. In some embodiments, the applicator is a mechanical pump. In some embodiments, there is more than one applicator 190 on the hair color device 100. In some embodiments, all the applicators 190 dispense the same hair color at different locations. In some embodiments, the applicators 190 may dispense different formulas, i.e., one applicator 190 dispenses hair color, while another applicator 190 dispenses hair color treatment. In some embodiments, the user can attach a hair color treatment cartridge to the hair color device, apply the treatment, and then swap out the cartridge for a hair color cartridge, so the same applicator may dispense the hair color treatment and the hair color device. In operation, as a user brushes the hair color device 100 through their hair, a hair color may be dispensed by the applicator onto one or more hairs with an undesired hair color, providing a way to dye a localized and precise portion of the user's hair.

FIG. 2 is an internal view of an example hair color device 100, in accordance with the present technology. In some embodiments, FIG. 2 is an internal illustration of the hair color device 100 in FIGS. 1A-1B. In some embodiments, the hair color device 100 has a form factor similar to a comb. In some embodiments, the hair color device 100 includes a cartridge 110, an accelerometer 120, a gyroscope 130, a contact sensor 150, a processor 160, a contact pin 165, a battery 170, an IR camera 175, a light source 180, and an optical system 185 disposed in the body 105 of the hair color device 100.

The illustrated hair color device 100 includes an accelerometer 120 and a gyroscope 130. In some embodiments, the accelerometer 120 and the gyroscope 130 are communicatively coupled to the processor 160. In operation, the accelerometer 120 measures the vibration or acceleration of the hair color device in the x, y, and z direction to determine the orientation of the hair color device 100. The gyroscope 130, in operation similarly detects the angular velocity and orientation of the hair color device 100.

In some embodiments, the hair color device 100 includes a contact sensor 150, communicatively coupled to the processor 160. In some embodiments, the contact sensor is also communicatively coupled to a contact pin 165. In some embodiments, the contact sensor 150 communicatively coupled to the contact pin 165 on the hair color device 100 is configured to sense proximity to a user's hair. In some embodiments, the contact pin 165 is on one or more of the plurality of bristles 115. In operation, as a user brushes the hair color device 100 through their hair, the contact pin 165 detects the proximity between the plurality of bristles 115 and the user's scalp (not pictured in FIG. 2). The contact pin can communicate this proximity to the contact sensor 150, which can likewise communicate to the processor 160, to determine if the plurality of bristles 115 are in close enough proximity to the scalp to apply the hair color. While there is only a single contact pin 165 illustrated in FIG. 2, the hair color device 100 may have any number of contact pins 165, including a contact pin 165 on each of the bristles in the plurality of bristles 115 on the hair color device 100. In some embodiments, each individual contact pin 165 gives a separate proximity so that hair color is only applied by the applicator(s) 190 in the area in sufficient contact with the scalp.

In some embodiments, the hair color device 100 includes a battery 170. Though battery 170 is further described, the hair color device can include other power sources, for example, capacitors. In an embodiment, the battery 170 is a rechargeable battery 170 configured to receive electrical power from an external source when, for example, electrical power of the rechargeable battery 170 has been depleted. In another embodiment, the battery 170 is a single-use battery 170. In an embodiment, a useable life of the single-use the battery 170 corresponds to an intended use interval of the hair color device 100. As the hair color device 100 is used over time, it may become worn, dirty, or otherwise unsuitable to provide its intended benefits. In this regard, as the single-use battery 170 is used up and runs out of power, the hair color device 100 may be configured to signal to a user that the hair color device 100 is ready for replacement, cleaning, reconditioning, and the like.

In some embodiments, the hair color device 100 further includes an IR camera 175, a light source 180, and an optical system 185 communicatively coupled to the processor 160. In some embodiments, the light source 180 and the IR camera 175 are communicatively coupled to the optical system 185. In some embodiments, the hair color device further includes an optical system configured to determine if the light conditions are suitable for visualizing the user's hair. In some embodiments, the optical system 185 can sense as to whether the user is in adequate lighting conditions to detect hairs of an undesired color on the user's head with the IR camera, as described in more detail in FIG. 3. If it is determined that the user is not in adequate lighting conditions, the light source 180 may illuminate the user's hair to better detect the hairs of an undesired color. If this is still not enough light to detect the user's hair, such as if the user is in a dark room, the hair color device 100 may alert the user to move to another location. After the lighting conditions are determined to be adequate to detect the user's hair, the IR camera may visualize an image of the user's hair.

As the user brushes or combs the hair color device 100 through his or her hair, the IR camera visualizes images of the user's hair. The processor can then assign a probability to each pixel of each image as being either (1) a desired hair, (2) an undesired hair, or (3) scalp based on the color of each pixel. In some embodiments, the desired hair is a hair that is a desired color that a user wishes their hair to be. In some embodiments, the desired color is the color of the hair color in the cartridge 110 of the hair color device 100. In some embodiments, a user may select the desired hair color, either with a user interface on the hair color device, or a separate communication device communicatively coupled to the hair color device. In some embodiments the undesired hair is a hair that is an undesired color. In some embodiments, the undesired color is selected from grey or white. In some embodiments, the undesired color is the user's natural hair color, such as when a user's roots grow out after a user has dyed their hair.

In some embodiments, the processor 160 sets a probability threshold for determining whether or not to apply hair color to the pixels that have a probability of being an undesired hair. In some embodiments, the probability threshold is hardcoded into the processor 160. In some embodiments, the probability threshold may be adjusted to the user's preferences or needs. For example, the threshold may need to higher if the desired hair color and the undesired hair color are not very distinct from each other, such as when a user is trying to dye their dark brown hair to black. The threshold may likewise be lowered when the desired hair color and the undesired hair color are distinct from one another, such as when a user is trying to dye blond hair black. In some embodiments, the probability threshold is set at 85%, 90%, 95%, or 100%. If the probability assigned to the pixel exceeds the probability threshold, the processor 160 directs the applicator 190 to apply hair color to that specific area. In some embodiments, processor 160 can detect one or more strands of hair based upon line segments of pixels. In this case, if the average of the pixels within the strand of hair exceeds the probability threshold, the processor 160 can direct the applicator 190 to apply hair color to the specific strand of hair.

In some embodiments, the hair color device 100 includes a plurality of bristles 115. In some embodiments, the plurality of bristles is spaced apart with a variable step distance so that more or less hair is separated by the plurality of bristles 115. In some embodiments, the plurality of bristles 115 are hollow. In some embodiments, only one or more bristles 115*a*, 115*b*, 115*c* of the plurality of bristles 115 is hollow. In some embodiments, one or more bristles 115*a*, 115*b*, 115*c* are disposed over one or more applicators 190, so that when the applicators apply hair color, it is applied through the one or more bristles 115*a*, 115*b*, 115*c*. While three bristles 115*a*, 115*b*, 115*c* are illustrated, any number of bristles may be disposed over the one or more applicators 190, including the entire plurality of bristles 115.

Figure 3:
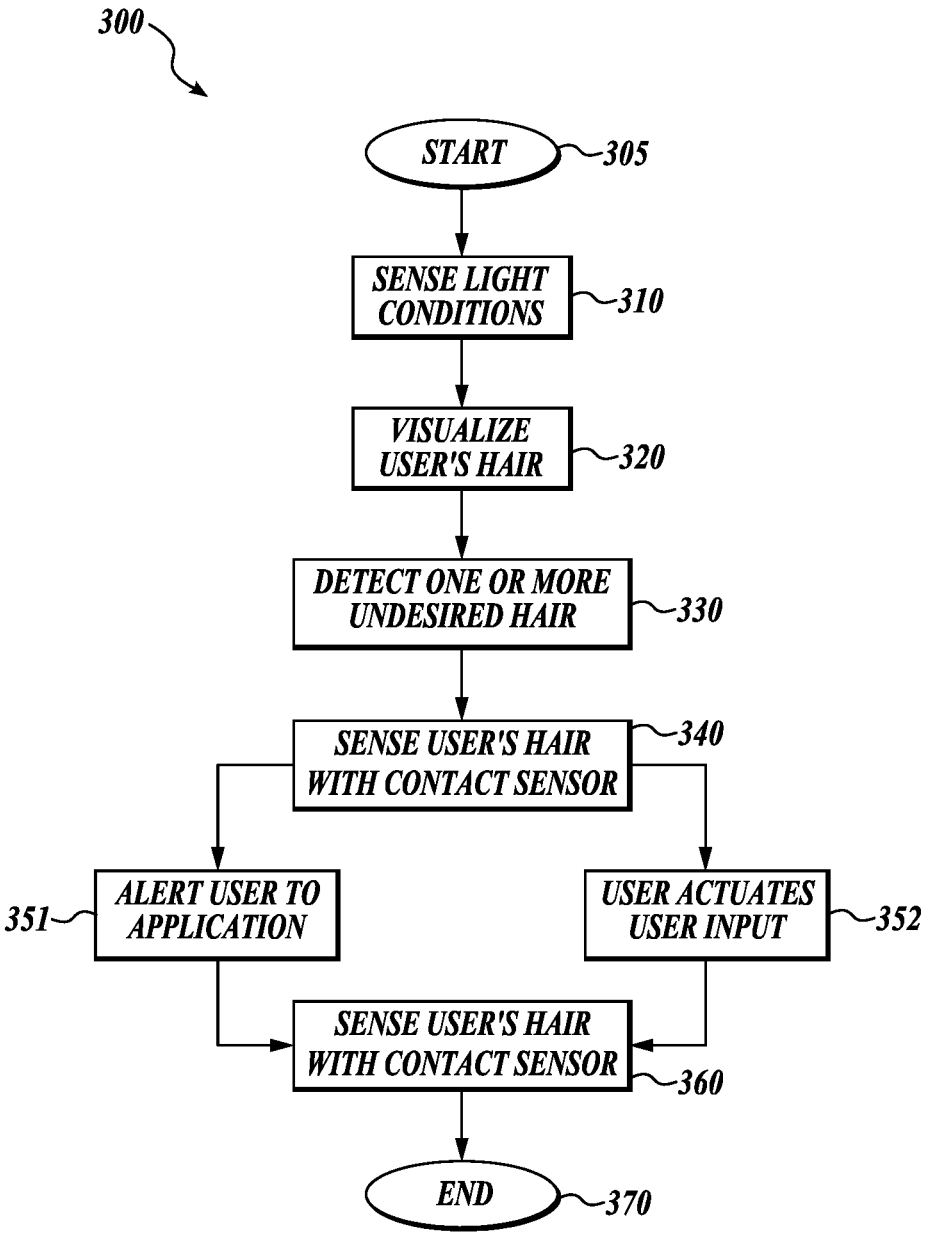
FIG. 3 is a flowchart of a method of coloring hair, in accordance with the present technology.

FIG. 3 is a flowchart of a method of coloring hair, in accordance with the present technology. In block 300, the method starts. In block 310, the light conditions of a location are sensed. The light conditions may be sensed with a light sensor. In some embodiments, the light sensor is on a hair color device (such as hair color device 100). In other embodiments, the light sensor is on a communication device, such as a smartphone or tablet. In some embodiments, the optical system takes a light reading of the surrounding area to ensure that it will be able to visualize the user's hair as described herein. In some embodiments, the hair color device includes a light source that turns on if the optical system detects the light conditions are less than adequate. In some embodiments, the hair color device, the communication device, or both alert the user to move into more optimal conditions to begin the visualization. In some embodiments, the user initiates the light sensor reading by actuating a user-input on the hair color device or the communication device.

In block 320, the user's hair is visualized. In some embodiments, the user's hair is visualized with an IR camera on the hair color device, but in other embodiments, the user's hair is visualized with a communication device. In some embodiments, the user can move the hair color device over their hair to sense the entirety of their hair. In some embodiments, the user may select a particular location, such as the roots of the hair, to move the hair color device over.

In block 330, the IR camera visualizes images of the user's hair. The processor can then assign a probability to each pixel of each image as being either (1) a desired hair, (2) an undesired hair, or (3) scalp. In some embodiments, the processor assigns the probability based on the color of the pixel. In some embodiments, the processer assigns the probability based on detected segments in the image. In another embodiment, the processor assigns the probability based on both the color of the pixel and detected segments in the image. As described herein, the desired hair is a desired hair color. The desired hair color can be selected by the user or correlate with the color of the hair color in the cartridge in the hair color device. In some embodiments the undesired hair is a hair that is an undesired color. In some embodiments, the undesired color is grey or white. In some embodiments, the undesired color is the user's natural hair color, such as when a user's roots grow out after a user has dyed their hair. In some embodiments, the undesired hair color is any color that is distinct from the desired hair color.

In some embodiments, the processor 160 can set a probability threshold for determining whether or not to apply hair color to the pixels that have a probability of being an undesired hair. In some embodiments, the probability threshold is hardcoded into the processor 160. In some embodiments, the probability threshold may be adjusted to the user's preferences or needs. In some embodiments, the probability threshold is set at 85%, 90%, 95%, or 100%. If a pixel exceeds the probability threshold, the processor 160 directs the applicator 190 to apply hair color to that specific area. In some embodiments, the processor 160 can detect one or more strands of hair based upon segment lines of pixels. In this case, if the average of the pixels within the segment exceeds the probability threshold, the processor 160 can direct the applicator 190 to apply hair color to the specific strand of hair.

Optionally, in block 340, the hair color device senses its proximity to the user's hair with a contact sensor. In some embodiments, the proximity to the user's hair is sensed with a contact sensor to ensure that the hair color will be applied only to the one or more undesired hairs. In some embodiments, the user can move the device closer to their hair in order to ensure the hair care material is applied, as described herein, in the target areas. In some embodiments, the hair color device or the communication device alerts the user to move the hair color device closer or farther from their hair.

Optionally, in block 351, the hair color device alerts the user that it will start applying the hair color and/or hair color treatment. In some embodiments, the alert is an auditory alert. In some embodiments, the alert is a tone or a blinking LED. In some embodiments, the alert is issued on the communication device instead of the hair color device. Alternatively, in block 352, the hair color device waits to apply the hair color and/or hair color treatment until it receives a command from the user. In some embodiments, the command is given by the user by actuating a user input. In some embodiments, the user input is a button, touch pad, or switch. In some embodiments, the command is given with the communication device, such as by a user actuating the touch screen of the communication device in response to a notification or pop up on the communication device.

In block 360, the hair color and/or hair color treatment is applied to the user's hair in the detected locations. In some embodiments, the user can move the hair color device over their hair to apply the hair color and/or hair color treatment. In some embodiments, block 360 happens simultaneously with blocks 330 and 340, so as the hair color device detects the one or more hairs and ensures it is in proximity with the user's hair, it also applies the hair color and/or hair color treatment to the user's hair.

In operation, a user can move the hair color device over their hair, the hair color device can detect, for example, any gray hairs the user may have and immediately apply a hair color to the user's gray hairs. Optionally, the user can move the hair color device over their hair multiple times to ensure any gray hairs they have are covered in dye.

In block 370, the method ends.

Figure 4:
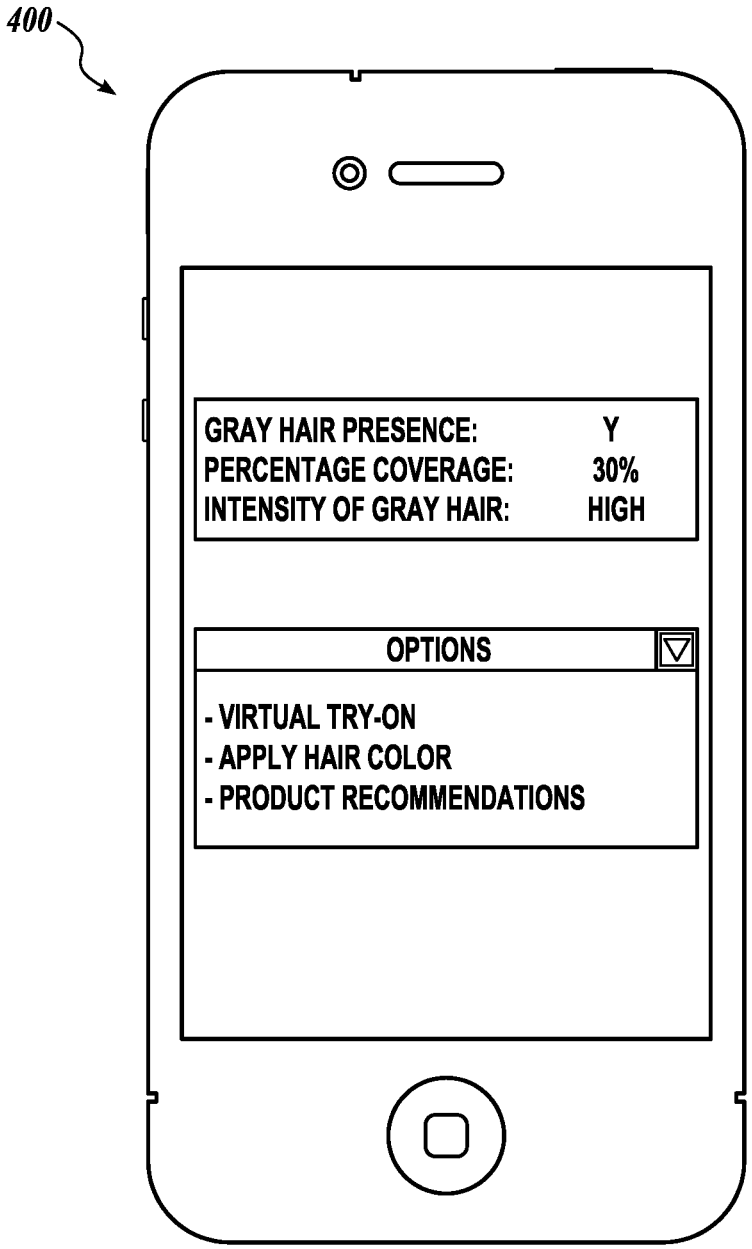
FIG. 4 is an example dashboard configured to be used in connection with hair color devices as described herein, in accordance with the present technology.

FIG. 4 is an example dashboard 400 configured to be used in connection with hair color devices 100 as described herein, in accordance with the present technology. In some embodiments, a hair color device 100 is configured to communicatively couple with a smart device, such as a smartphone as illustrated in FIG. 4. In some embodiments, the smart device may take the form of a personal computer, tablet, laptop, or the like.

In some embodiments, the smart device is configured to display a dashboard 400. In some embodiments, the dashboard 400 may be displayed on the hair color device 100 itself.

In some embodiments, the dashboard 400 includes outputs to a user. In some embodiments, the outputs include an indicator of whether grey hair is present, a percentage of coverage of grey hair (i.e., the percentage of hair on a user's head that is grey), and an intensity of grey hair. These outputs should be understood as merely representative, and any sort of outputs may be included.

In some embodiments, the intensity of grey hair is determined by how light the hair is. For example, a user whose hair has turned white would be considered to have "high" intensity grey hair, while a user with darker grey hair would be considered to have "low" intensity grey hair. In some embodiments, the intensity is determined by how much or what concentration of hair product would need to be applied to cover the grey hair. In such embodiments, "high" intensity grey hair would be hair that requires more hair product to cover, while "low" intensity grey hair would require less hair product.

In some embodiments, the dashboard 400 further includes a set of options. While the options are illustrated as a drop-down menu, it should be understood that the options may be arranged and/or displayed in any form. In some embodiments, the options include a virtual try on, a button to apply a hair color, and product recommendations.

In some embodiments, the virtual try on will allow a user to see a desired hair color on themselves using the camera of the smart device. In some embodiments, the virtual try on allows a user to take a photo of their hair and overlay a desired color on the photo. In some embodiments, the virtual try on allows a user to use the camera of the smart device to capture images or video in real-time and overlay the color over the real time images or video of the user's hair.

In some embodiments, the apply hair color option acts as an actuator for the hair color device (such as hair color device 100). In such embodiments, the user can actuate the apply hair color option (such as by pressing a button or utilizing a touch screen) to apply the hair color from the hair color device.

Embodiments disclosed herein may utilize circuitry in order to implement technologies and methodologies described herein, operatively connect two or more components, generate information, determine operation conditions, control an appliance, device, or method, and/or the like. Circuitry of any type can be used. In an embodiment, circuitry includes, among other things, one or more computing devices such as a processor (e.g., a microprocessor), a central processing unit (CPU), a digital signal processor (DSP), an application-specific integrated circuit (ASIC), a field-programmable gate array (FPGA), or the like, or any combinations thereof, and can include discrete digital or analog circuit elements or electronics, or combinations thereof.

In an embodiment, circuitry includes one or more ASICs having a plurality of predefined logic components. In an embodiment, circuitry includes one or more FPGA having a plurality of programmable logic components. In an embodiment, circuitry includes hardware circuit implementations (e.g., implementations in analog circuitry, implementations in digital circuitry, and the like, and combinations thereof). In an embodiment, circuitry includes combinations of circuits and computer program products having software or firmware instructions stored on one or more computer readable memories that work together to cause a device to perform one or more methodologies or technologies described herein. In an embodiment, circuitry includes circuits, such as, for example, microprocessors or portions of microprocessor, that require software, firmware, and the like for operation. In an embodiment, circuitry includes an implementation comprising one or more processors or portions thereof and accompanying software, firmware, hardware, and the like. In an embodiment, circuitry includes a baseband integrated circuit or applications processor integrated circuit or a similar integrated circuit in a server, a cellular network device, other network device, or other computing device. In an embodiment, circuitry includes one or more remotely located components. In an embodiment, remotely located components are operatively connected via wireless communication. In an embodiment, remotely located components are operatively connected via one or more receivers, transmitters, transceivers, or the like.

An embodiment includes one or more data stores that, for example, store instructions or data. Non-limiting examples of one or more data stores include volatile memory (e.g., Random Access memory (RAM), Dynamic Random Access memory (DRAM), or the like), non-volatile memory (e.g., Read-Only memory (ROM), Electrically Erasable Programmable Read-Only memory (EEPROM), Compact Disc Read-Only memory (CD-ROM), or the like), persistent memory, or the like. Further non-limiting examples of one or more data stores include Erasable Programmable Read-Only memory (EPROM), flash memory, or the like. The one or more data stores can be connected to, for example, one or more computing devices by one or more instructions, data, or power buses.

In an embodiment, circuitry includes one or more computer-readable media drives, interface sockets, Universal Serial Bus (USB) ports, memory card slots, or the like, and one or more input/output components such as, for example, a graphical user interface, a display, a keyboard, a keypad, a trackball, a joystick, a touch-screen, a mouse, a switch, a dial, or the like, and any other peripheral device. In an embodiment, circuitry includes one or more user input/output components that are operatively connected to at least one computing device to control (electrical, electromechanical, software-implemented, firmware-implemented, or other control, or combinations thereof) one or more aspects of the embodiment.

In an embodiment, circuitry includes a computer-readable media drive or memory slot configured to accept signal-bearing medium (e.g., computer-readable memory media, computer-readable recording media, or the like). In an embodiment, a program for causing a system to execute any of the disclosed methods can be stored on, for example, a computer-readable recording medium (CRMM), a signal-bearing medium, or the like. Non-limiting examples of signal-bearing media include a recordable type medium such as any form of flash memory, magnetic tape, floppy disk, a hard disk drive, a Compact Disc (CD), a Digital Video Disk (DVD), Blu-Ray Disc, a digital tape, a computer memory, or the like, as well as transmission type medium such as a digital and/or an analog communication medium (e.g., a fiber optic cable, a waveguide, a wired communications link, a wireless communication link (e.g., transmitter, receiver, transceiver, transmission logic, reception logic, etc.). Further non-limiting examples of signal-bearing media include, but are not limited to, DVD-ROM, DVD-RAM, DVD+RW, DVD-RW, DVD-R, DVD+R, CD-ROM, Super Audio CD, CD-R, CD+R, CD+RW, CD-RW, Video Compact Discs, Super Video Discs, flash memory, magnetic tape, magneto-optic disk, MINIDISC, non-volatile memory card, EEPROM, optical disk, optical storage, RAM, ROM, system memory, web server, or the like.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification.

In the foregoing description, specific details are set forth to provide a thorough understanding of exemplary embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The invention claimed is:

1. A system for coloring hair, the system comprising:

at least one cartridge containing a hair color;

an applicator configured to apply the hair color;

a hair color device configured to receive the at least one cartridge;

a plurality of bristles configured to separate hair into sections for imaging wherein one or more bristles of the plurality of bristles are hollow and disposed over the applicator, so that when the applicator applies hair color, it is applied through the one or more bristles;

a plurality of contact pins located on the one or more bristles of the plurality of bristles;

an infrared (IR) camera; and a processor communicatively coupled to the hair color device, wherein the processor is configured to:

visualize an image of a user's hair with the IR camera;

set a probability threshold for an undesired hair color;

assign a probability to each pixel of the image as being: a desired hair, an undesired hair, or scalp, wherein the desired hair is a desired color and wherein the undesired hair is an undesired color;

determine the proximity of a respective bristle of the plurality of bristles from the scalp based on a measurement from the plurality of contact pins; and apply the hair color onto the one or more pixels that exceed the probability threshold of the undesired hair color through the applicator on the hair color device through the respective bristle when the respective bristle of the plurality of bristles meets or exceeds a proximity threshold.

2. The system of claim 1, wherein the applicator is a piezoelectric pump.

3. The system of claim 1, wherein the applicator is a mechanical pump.

4. The system of claim 1, wherein the hair color device further comprises an optical system configured to determine if the light conditions are suitable for visualizing the user's hair.

5. The system of claim 1, wherein the hair color is semi-permanent hair dye, or a wash-out hair dye.

6. The system of claim 1, wherein the system further comprises a second cartridge containing a hair color treatment.

7. The system of claim 6, wherein the hair color is demi-permanent hair dye, or a permanent hair dye.

8. The system of claim 6, wherein the hair color treatment is a toner.

9. The system of claim 6, wherein the hair color treatment is an oxidant.

10. The system of claim 1, wherein the undesired color is selected from grey or white.

11. The system of claim 1, wherein the undesired color is the user's natural hair color.

12. The system of claim 1, wherein the desired color is the color of the hair color in the cartridge.

13. A method of coloring hair using the system of claim 1, the method comprising:

visualizing an image of a user's hair with an IR camera;

setting a probability threshold for an undesired hair color;

assigning a probability to each pixel of the image as being a desired hair, an undesired hair, or scalp, wherein the desired hair is a desired hair color, and wherein the undesired hair is the undesired hair color; and applying the hair color onto the one or more pixels that exceed the probability threshold of the undesired hair color through an applicator on the hair color device.

14. The method of claim 12, wherein the undesired color is selected from white or grey.

15. The method of claim 12, wherein the undesired color is the user's natural hair color.

16. The method of claim 12, wherein the method further comprises sensing the user's hair with a contact sensor to ensure the hair color is applied only to the one or more undesired hairs.

17. The method of claim 12, wherein the method further comprises alerting the user that the hair color treatment will be applied.

* * * * *